US007093584B1

(12) United States Patent
Potter et al.

(10) Patent No.: US 7,093,584 B1
(45) Date of Patent: Aug. 22, 2006

(54) FUEL INJECTOR NOISE MUFFLERS

(75) Inventors: Duane E. Potter, Webster, NY (US); Charles W. Braun, Livonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/207,363

(22) Filed: Aug. 19, 2005

(51) Int. Cl.
*F02M 63/00* (2006.01)
*F02M 63/02* (2006.01)

(52) U.S. Cl. ..... 123/447; 123/456; 123/463

(58) Field of Classification Search ..... 123/447, 123/456, 463, 468, 470, 533.1, 533.2, 533.3, 123/533.4, 88, 89
See application file for complete search history.

(56) References Cited

U.S. PATENT DOCUMENTS 5,024,198 A * 6/1991 Usui ..... 123/468
5,207,387 A 5/1993 Bergstrom
5,782,222 A * 7/1998 Morris et al. ..... 123/456
6,470,859 B1 * 10/2002 Imura et al. ..... 123/467
6,615,801 B1 * 9/2003 Zdroik ..... 123/467
6,629,650 B1 * 10/2003 Curran et al. ..... 239/585.1
6,742,504 B1 6/2004 Seymour, II et al.
6,761,150 B1 * 7/2004 Zdroik ..... 123/456
6,854,447 B1 2/2005 Miandoab et al.
6,871,637 B1 3/2005 Tsuchiya et al.
6,877,484 B1 4/2005 Reiter
6,892,704 B1 5/2005 Tsuchiya et al.
6,901,913 B1 6/2005 Tsuchiya et al.
6,901,964 B1 6/2005 Kippe et al.
6,904,894 B1 6/2005 Serizawa et al.
6,905,002 B1 6/2005 Bagga et al.
2005/0039725 A1 2/2005 Treusch et al.
2005/0109323 A1 5/2005 Zdroik et al.
2005/0133008 A1 6/2005 Zdroik et al.

* cited by examiner

*Primary Examiner*—Mahmoud Gimie
(74) *Attorney, Agent, or Firm*—Jimmy L. Funke

(57) ABSTRACT

Several embodiments of noise reduction apparatus for a fuel injector are disclosed and include perforated tubes, side branch filters and expansion chambers strategically located between a respective injector and the fuel rail to target and reduce high frequency noise generated by the mechanical movement of the fuel injector.

2 Claims, 2 Drawing Sheets

FUEL INJECTOR NOISE MUFFLERS

TECHNICAL FIELD

The present invention relates to noise control of fuel injectors in an internal combustion engine. More particularly, the present invention relates to various devices and methods for reducing or eliminating noise caused by the mechanical movement of the fuel injectors.

BACKGROUND OF THE INVENTION

Fuel injector systems, which deliver fuel to the combustion chamber of internal combustion engines, have been around for many years. The fuel injection system draws fuel from a fuel tank, through tubing, to a fuel rail mounted adjacent the cylinder bank or banks of the engine. The fuel injectors, typically one for each cylinder, extend from the fuel rail to inject the fuel in proximity to an intake valve for a respective cylinder. The fuel injectors are electro-mechanical devices which have moving parts that deliver the fuel in precise amounts and times to the respective cylinder. While the engine is running, the fuel injectors are essentially constantly working. Noise having various frequencies is thus generated by the fuel injectors. High frequency noise is generated by the mechanical movement of the injector and low frequency pressure waves are generated by the movement of the fuel itself. Both the high and low frequencies travel through the fuel rail and cause unwanted noise. Manufacturers are thus continuously looking for ways which effectively reduce or eliminate this noise. Prior art noise control measures are typically directed at reducing the component of the noise caused by the lower frequency pressure waves within the fuel rail, e.g., by providing flexible walls in the area of the fuel rail which act to absorb acoustic/pressure waves. Such methods which target noise generated by the fluid movement are not effective at reducing higher frequency noise caused by the mechanical movement of the fuel injector. Acoustic covers are also known which are applied to various places within the engine compartment in an attempt to absorb noise, however, they are not always effective at absorbing both high and low frequency noise which is generated by the fuel injectors. Furthermore, acoustic covers are bulky and may inhibit effective cooling of the engine compartment. There therefore remains a need for improved devices and methods that substantially reduce noise generated by fuel injectors and which are not bulky or costly, and which will not adversely affect the temperature of the engine compartment.

SUMMARY OF THE INVENTION

The present invention addresses the above described need by providing devices and methods that substantially reduce noise caused by the mechanical movement of the fuel injectors in an internal combustion engine. In a first embodiment, a muffler is provided in the socket between the fuel injector and the fuel rail. The inlet and outlet of the muffler are offset such that the sound pressure wave created by the mechanical movement of the injector exits the injector through a first tube, reflects off surfaces of the muffler cavity (socket), and enters the rail through a second tube offset from the first tube. Both tubes are preferably perforated for the addition of other frequency pressure waves into the cavity. The reflections of the various pressure waves in the muffler cavity cause destructive interference and substantially reduce the main sound pressure wave.

In a second embodiment, a side branch filter is provided between the fuel injector and the fuel rail. The side branch filter is in the form of an elongated passage with a closed end and extends from the fuel injector socket. The length of the passage is about ¼ the wavelength of the pressure wave targeted to be reduced or eliminated. As such, the pressure wave will enter the side branch filter, reflect off the closed end of the passage and re-enter the injector socket 180° out of phase with the original pressure wave causing destructive interference and thereby reducing or eliminating the main pressure wave in the injector socket before it reaches the fuel rail.

In a third embodiment, an expansion chamber is provided between the fuel injector and fuel rail. The expansion chamber changes the volume of the area through which the fuel passes and acts to substantially reduce the sound pressure wave traveling therethrough. As with the side branch filter, the size of the expansion chamber may be selected and calibrated to the specific frequencies being targeted for reduction or elimination. This embodiment of noise control device and method is able to cover a broader frequency band than the side branch filter.

In a fourth embodiment, a single perforated tube is associated with a respective fuel injector and extends from its respective fuel injector socket and into the fuel rail. The sound pressure wave emanating from the injector enters the respective socket and perforated tube. The pressure waves are then forced through the tube perforations into the main rail cavity. The refection that occurs due to the volume change reduces the undesired sound pressure wave.

Any two or more of the embodiments described herein may of course be combined as desired to achieve the desired noise reduction effect.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
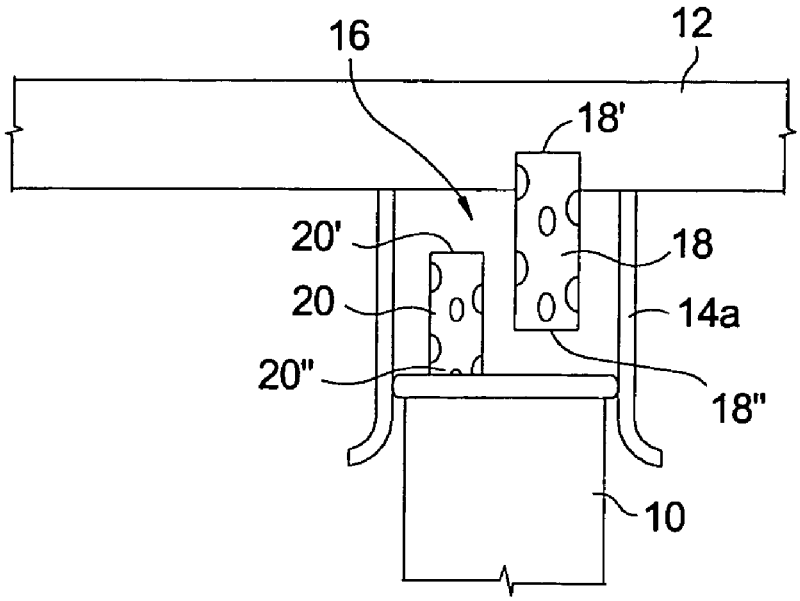
FIG. 1 is a side elevational view with parts broken away of a first embodiment of the invention.

Referring now to the drawings, there is seen in FIG. 1 a first embodiment of the invention incorporated into a fuel assembly having at least one fuel injector 10 connected to a fuel rail 12 by an injector socket 14*a*. The injector socket 14*a* defines a cavity 16 wherethrough fuel travels from the fuel rail 12 to the fuel injector 10. The fuel injector is operable to deliver fuel into the intake port of the cylinder of the engine (not shown). A first embodiment of the invention comprises a muffler in the form of first and second tubes 18,20 placed in cavity 16. First tube 18 has a fuel inlet end 18' connected to the fuel rail 12, and a fuel outlet end 18" wherethrough fuel flows out of the tube and into the socket cavity 16. Second tube 20 is placed in spaced, parallel relation to first tube 18 in socket cavity 16 and has a fuel inlet end 20' and fuel outlet end 20". Fuel inlet end 20' is located in cavity 16 and receives fuel which came from the outlet end of the first tube. In this regard, it is seen that the outlet end 18" of tube 18 is closer to injector 10 than the inlet end 20' of tube 20. The outlet end 20" of second tube 20 connects and delivers the fuel to respective fuel injector 10.

The movement of the fuel injector generates pressure waves which travel through the fuel line in the direction opposite to fuel flow. The pressure waves will thus exit the fuel outlet end 20" of the second tube 20 and enter the fuel outlet end 18" of the first tube 18. The reflections of the various pressure waves in cavity 16 cause destructive interference and substantially reduce the main sound pressure wave and noise is substantially reduced.

Figure 2:
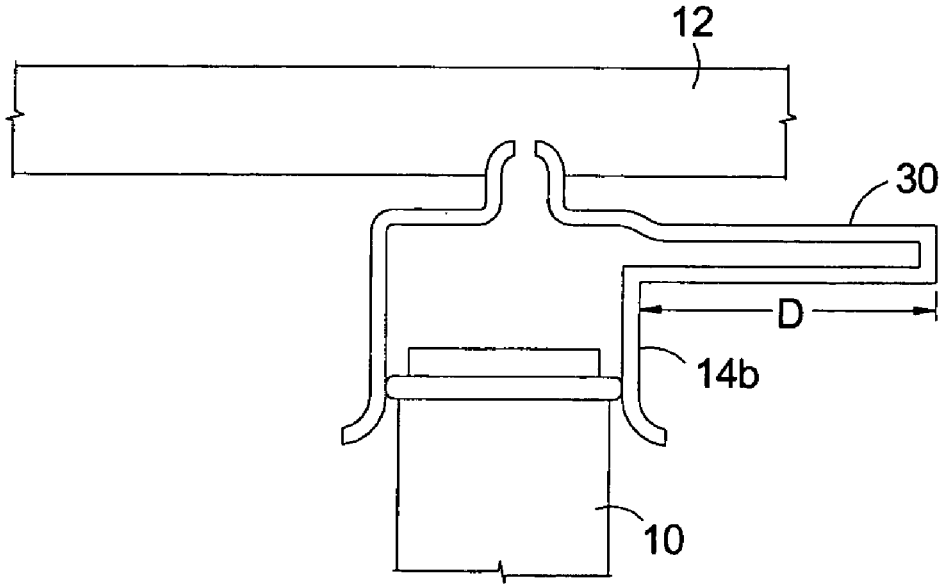
FIG. 2 is a side elevational view with parts broken away of a second embodiment of the invention.

A second embodiment of the invention is seen in FIG. 2 wherein a side branch filter 30 extends from modified socket 14*b*. Side branch filter 30 has a length "D" that is ¼ the wavelength of the frequency of the pressure wave emanating from injector 10. According to the known equation:

$$D = \frac{\lambda}{4} = \frac{V}{4F} \qquad \text{(Eq. 1)}$$

where

λ=wavelength

V=Velocity of Sound in the Fluid and

F=Noise Frequency, a side branch filter having a length D that is ¼ of the propagating wave frequency will produce a reflected wave that is 180° out of phase with the propagated wave, thereby canceling the propagated wave and reducing noise. For example, if V=1140 m/s and the undesirable frequency is 5000 Hz, then D=57 mm.

Figure 3:
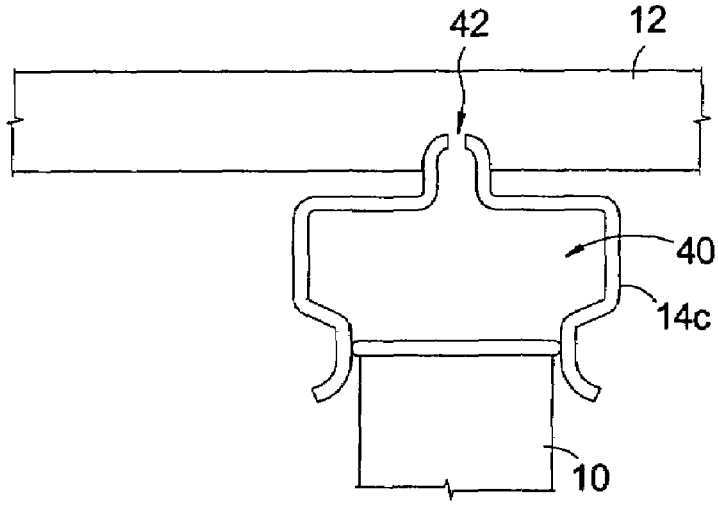
FIG. 3 is a side elevational view with parts broken away of a third embodiment of the invention.

A third embodiment of the invention is seen in FIG. 3 wherein a modified socket 14*c* defining an expansion chamber 40 is provided between injector 10 and the fluid port 42 communicating with fuel rail 12. An expansion chamber changes the volume of a flow path which causes sound reflection that reduces the originating pressure wave. The calculation of the length of the expansion chamber 40 follows the same procedure as outlined above for the side branch filter, however, this method of sound attenuation is able to target a larger frequency range than the side branch filter.

Figure 4:
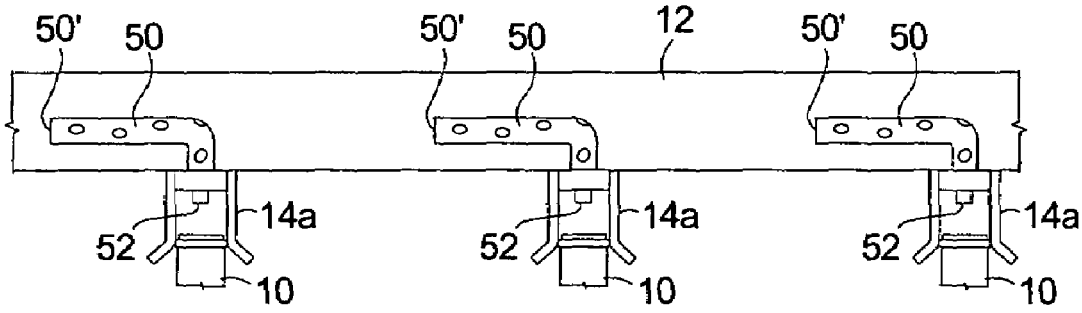
FIG. 4 is a side elevational view with parts broken away of a fourth embodiment of the invention.

FIG. 4 shows yet a fourth embodiment of the invention wherein a perforated tube 50 extends from a respective socket 14*a* and injector port 52, into the fuel rail 12, terminating at a closed end 50'. In the preferred embodiment, the portion of the tube including closed end 50' extends substantially parallel to fuel rail 12 and may or may not be coaxial therewith. The pressure wave originating from injector 12 travels through the perforated tube 50 and is forced through the tube perforations into the main rail cavity. The refection that occurs due to the volume change reduces the undesired sound pressure wave.

What is claimed is:

1. A fuel injector system for an internal combustion engine comprising a fuel rail for delivering fuel to said internal combustion engine;

a socket attached to the fuel rail and defining a fuel flow path receiving the fuel from the fuel rail;

a fuel injector inserted into the socket and adapted to receive fuel from the fuel flow path through the socket;

a side branch filter extending from said socket perpendicular to the fuel flow path and comprising an elongated passage defining a constant volume, said side branch filter having a closed end adapted to reflect pressure waves propagating within the passage from the fluid flow path and having a length effective to cancel the pressure waves.

2. A fuel injector system for an internal combustion engine comprising a fuel rail for conveying fuel to said internal combustion engine;

a socket attached to the fuel rail;

a fuel injector inserted into the socket and adapted to receive fuel from the fuel flow path through the socket;

a perforated tube having first and second ends, said first end being open and disposed within the socket, said second end being closed and extending into said fuel rail.

* * * * *